US008173205B2

(12) United States Patent
Heo et al.

(10) Patent No.: US 8,173,205 B2
(45) Date of Patent: May 8, 2012

(54) METHOD FOR FABRICATING ZNO THIN FILMS

(75) Inventors: Jeong Na Heo, Yongin-si (KR); Jeong Hee Lee, Seongnam-si (KR)

(73) Assignee: Samsung Electronics Co., Ltd. (KR)

( * ) Notice: Subject to any disclaimer, the term of this patent is extended or adjusted under 35 U.S.C. 154(b) by 863 days.

(21) Appl. No.: 12/126,380

(22) Filed: May 23, 2008

(65) Prior Publication Data

US 2009/0035457 A1 Feb. 5, 2009

(30) Foreign Application Priority Data

Jul. 31, 2007 (KR) ..... 10-2007-0076920

(51) Int. Cl.
*B05D 5/12* (2006.01)

(52) U.S. Cl. ..... 427/126.3; 427/383.1

(58) Field of Classification Search ..... 427/126.3, 427/383.1

See application file for complete search history.

(56) References Cited

U.S. PATENT DOCUMENTS

| | | | | |
|---|---|---|---|---|
| 6,068,755 | A | 5/2000 | Matsuda et al. | |
| 6,200,680 | B1 * | 3/2001 | Takeda et al. | 428/402 |
| 2005/0009224 | A1 | 1/2005 | Yang et al. | |
| 2006/0284171 | A1 * | 12/2006 | Levy et al. | 257/43 |

OTHER PUBLICATIONS

David Andeen et al, Crystal chemistry of epitaxial ZnO on (111) Mg AI2O4 produced by hydrothermal synthesis, Journal of Crystal Growth 259 (2003) 103-109.*

* cited by examiner

*Primary Examiner* — Brian K Talbot
(74) *Attorney, Agent, or Firm* — Cantor & Colburn LLP

(57) ABSTRACT

Disclosed is a method for fabricating ZnO thin films using a ZnO precursor solution containing zinc hydroxide nitrate ($Zn_5(OH)_8(NO_3)_2.2H_2O$) as a zinc supplier. The ZnO thin film is fabricated by using a simple and economical coating method at a low process temperature.

13 Claims, 3 Drawing Sheets

METHOD FOR FABRICATING ZNO THIN FILMS

This application claims priority to Korean Patent Application No. 10-2007-0076920, filed on Jul. 31, 2007, and all the benefits accruing therefrom under 35 U.S.C. §119, the contents of which in its entirety are hereby incorporated by reference.

BACKGROUND OF THE INVENTION

This disclosure relates to a method of fabricating zinc oxide (ZnO) thin films.

ZnO, which is a II-IV Group oxide, is a semiconductor substance having a hexagonal wurtzite crystal structure and a wide optical energy band gap of about 3.3 eV. ZnO thin film has a strong piezoelectricity and photoelectric effect. Thus the optical characteristics of ZnO thin films are similar to those of GaN used as a material for the conventional UV/blue light-emitting diodes (LEDs) and laser diodes (LDs). Especially, ZnO thin film is known to have advantageous characteristics. For example, it has an excitation binding energy three times higher than GaN at room temperature, thus resulting in more efficient emission. Also, ZnO thin film has a low threshold energy for stimulated spontaneous emission by laser pumping. In addition, ZnO thin film has excellent transmittance in the infrared and visible light regions, electrical conductivity, and durability to plasma, and its raw material cost is economical. Therefore, the application range of ZnO thin films is very wide, for example, TFTs, transparent electrodes by doping, photocatalysts, energy saving coating materials for window glasses, acousto-optic devices, ferroelectric memories, solar cells, or reduction gas detection sensors.

Techniques for growing the ZnO thin films include various coating methods such as a chemical vapor deposition, metal organic chemical vapor deposition, organometallic chemical vapor deposition, molecular beam deposition, organometallic molecular beam deposition, pulse laser deposition, atomic layer deposition, sputtering, RF magnetron sputtering, or the like. However, the equipment for carrying out these methods are expensive and their operations are not very simple. Moreover, when growing the ZnO thin films at high temperatures, the substrate underneath may be stressed by the high temperature.

In the preparation of a precursor solution of ZnO thin film, Zn acetate, Zn chloride, Zn nitrate and the like are used as a Zn supplier. In this case, the decomposition temperature (generally, 500° C. or higher) of these Zn suppliers is high. Thus, it is difficult to apply these Zn suppliers to a device for a flexible substrate or a glass substrate for a transparent electrode.

BRIEF SUMMARY OF THE INVENTION

Example embodiments are provided below for addressing certain deficiencies and/or limitations of the related art, a method for fabricating ZnO thin films through using a ZnO precursor solution by having zinc hydroxide nitrate ($Zn_5(OH)_8(NO_3)_2.2H_2O$) as a zinc supplier with a low decomposition temperature.

Example embodiments also provide a material for electric parts including the ZnO thin films obtained by the above method.

In accordance with the exemplary embodiments, a method for fabricating ZnO thin films includes: preparing a precursor solution for ZnO thin films in a sol-form by using zinc hydroxide nitrate ($Zn_5(OH)_8(NO_3)_2.2H_2O$); and coating the precursor solution for ZnO thin films on a substrate followed by drying and curing.

According to the exemplary embodiments, ZnO thin films can be obtained by using the ZnO precursor solution in a sol-form having zinc hydroxide nitrate ($Zn_5(OH)_8(NO_3)_2.2H_2O$) as a zinc supplier with a low decomposition temperature. The ZnO thin film of the exemplary embodiments is homogeneous due to an excellent chemical homogeneity, fluidity and reactivity of the reactants when in sol-form. Moreover, the equipment for fabricating the ZnO thin film is relatively simple, because the equipment does not require high vacuum, and the process cost is economical. In addition, since the ZnO thin film can be grown at low process temperatures, substrates to be used are not stressed. Thus, application of the ZnO thin film to a device for a flexible substrate or a glass substrate for a transparent electrode is easy, and the fabrication processability is excellent, because a conventional deposition method can be used.

BRIEF DESCRIPTION OF THE DRAWINGS

Exemplary embodiments will be more clearly understood from the following detailed description taken in conjunction with the accompanying drawings, in which.

DETAILED DESCRIPTION OF EXAMPLE EMBODIMENTS

Figure 1:
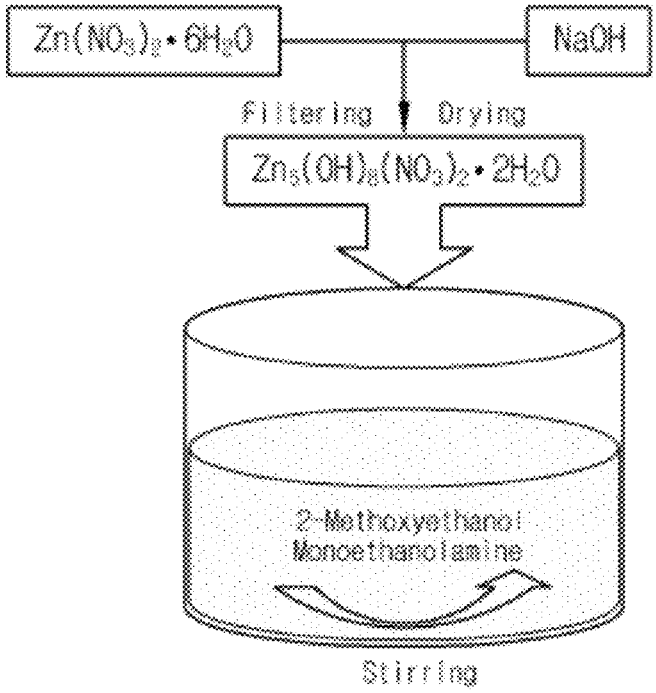
FIG. 1 is a schematic view illustrating a method of preparing a precursor solution for zinc oxide (ZnO) film according to an example embodiment.

Example embodiments will now be described in greater detail with reference to the accompanying drawings.

The terminology used herein is for the purpose of describing particular embodiments only and is not intended to be limiting of the invention. As used herein, the singular forms "a", "an" and "the" are intended to include the plural forms as well, unless the context clearly indicates otherwise. The use of the terms "first", "second", and the like do not imply any particular order but are included to identify individual elements. It will be further understood that the terms "comprises" and/or "comprising", or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

In the drawings, like reference numerals in the drawings denote like elements and the thicknesses of layer and regions are exaggerated for clarity.

Exemplary embodiments are directed to a method of fabricating ZnO thin films including: preparing a precursor solution for ZnO thin films in a sol-form by using zinc hydroxide nitrate ($Zn_5(OH)_8(NO_3)_2.2H_2O$); and coating the precursor solution for ZnO thin films on a substrate followed by drying and curing.

FIG. 1 is a schematic view illustrating a method of preparing a precursor solution for zinc oxide (ZnO) film according to an example embodiment. Referring to FIG. 1, first, an aqueous $Zn(NO_3)_2.6H_2O$ solution and NaOH are mixed and stirred. Subsequently, a precipitate is obtained by filtering the mixture. The precipitated substance is washed with ultra pure water for several times and then dried to obtain $Zn_5(OH)_8(NO_3)_2.2H_2O$. The dried $Zn_5(OH)_8(NO_3)_2.2H_2O$ is mixed with a polar solvent, along with a stabilizer or a modifier, and the mixture is stirred.

The stabilizer or modifier is added to achieve a homogeneous solution. Examples of the stabilizer include amine-based stabilizers such as monoethanolamine, diethanolamine or triethanolamine, but are not particularly limited thereto. Moreover, examples of the modifiers include organic dispersants such as acetoin, dimethylamineborane, glycine or acetol, or inorganic dispersants, but are not particularly limited thereto.

Examples of the polar solvents include alcohol solvents such as 2-methoxyethanol, ethanol or isopropanol, acetonitrile, or distilled water ($H_2O$). Preferably, 2-methoxyethanol may be used in that it has a relatively high boiling point so as to prevent volatilization of the solvent during coating, but is not particularly limited thereto.

According to another exemplary embodiment, the precursor solution for the ZnO thin film further includes at least one selected from the group consisting of aluminum (Al), indium (In), gallium (Ga), boron (B), iron (Fe), stibium (Sb), lithium (Li), phosphor (P), and arsenic (As) to improve electrical, optical and piezoelectric characteristics of the precursor solution for the ZnO thin film.

The precursor solution for ZnO thin film prepared in a homogeneous and transparent sol-form through the above method is applied on a substrate using a spin coating or dip coating method, and dried. Subsequently, the substrate coated with the precursor solution is cured on a hot plate at a temperature less than 200° C. to form a ZnO thin film according to the reaction equation below.

[Reaction Equation 1]

$$Zn_3(OH)_8(NO_3)_2 2H_2O \xrightarrow{80\text{-}120^\circ C.} Zn_3(OH)_8(NO_3)_2 + 2H_2O$$

$$Zn_3(OH)_8(NO_3)_2 \xrightarrow{120\text{-}140^\circ C.} Zn_3(OH)_8(NO_3)_2 + 2ZnO + 2H_2O$$

$$Zn_3(OH)_8(NO_3)_2 \xrightarrow{140\text{-}170^\circ C.} 3ZnO + 2HNO_3 + H_2O$$

According to another exemplary embodiment, the curing process may be carried out at a temperature of 200° C. or higher for crystallization of the ZnO thin film.

A concentration of zinc within the precursor solution for ZnO thin films is about 0.0005 to about 1 M, but is not particularly limited thereto. When the concentration is less than 0.0005 M, a thickness of the thin film to be formed may not be controlled. When the concentration exceeds 1 M, a transparent and homogeneous precursor solution cannot be obtained. In this case, the solvent is evaporated so that the concentration of Zn is controlled to be 0.1 M or higher without forming any precipitate.

A concentration of the stabilizer or modifier is controlled, depending upon the concentration of zinc in the precursor solution for ZnO thin film. The concentration of the stabilizer or modifier is about 5 to 100-fold of the concentration of zinc in the precursor solution for ZnO thin film, but is not particularly limited thereto. When the concentration exceeds 100-fold of the zinc concentration, a sub-reaction may occur.

Examples of the coating method include a spin coating, dip coating, roll coating, screen coating, spray coating, spin casting, flow coating, screen printing, ink jet, or drop casting, but are not particularly limited thereto.

The substrate employs a wafer substrate, an ITO substrate, a quartz glass substrate, or a plastic substrate, but is not limited thereto.

Exemplary embodiments are also directed to materials for electric parts including the ZnO thin films obtained by the method according to example embodiments. The materials for electric parts include a transparent electrode, a solar cell, a photo sensor, a TFT, a ZnO nanowire, or an emissive material, but are not limited thereto.

Hereinafter, example embodiments will be explained in more detail with reference to the following examples. However, these examples are given for the purpose of illustration and are not to be construed as limiting the scope of the invention.

EXAMPLES

Example 1

Preparation of ZnO Precursor Solution 20 ml of an aqueous 3.5 M $Zn(NO_3)_2.2H_2O$ solution and 50 ml of an aqueous 0.75M NaOH solution was mixed at room temperature and stirred. White precipitates were obtained by filtering the stirred mixture. The filtered $Zn_5(OH)_8(NO_3)_2.2H_2O$ was washed several times using ultra pure water, and dried at about 50° C. The dried $Zn_5(OH)_8(NO_3)_2.2H_2O$ and monoethanolamine (MEA) were mixed in 2-methoxyethanol, and stirred to prepare a homogeneous and stable ZnO precursor solution.

Example 2

Fabrication of ZnO Thin Film

The precursor solution prepared in Example 1 was spin-coated at 3000 rpm for 10 seconds, and then subjected to a preliminary heat treatment for 5 minutes in a hot plate at 110° C. Thereafter, a heat treatment was carried out at 150 to 500° C. for 1 hour under air atmosphere for crystallization.

Example 3

Fabrication of ZnO Nanowire

Using the ZnO thin film fabricated in Example 2 as a catalyst, a ZnO nanowire was grown in a thermal furnace. In order to grow the ZnO nanowire, the ZnO thin film fabricated in Example 2 was loaded into a thermal furnace and then heated up to 950° C. while supplying argon gas (Ar). When the process temperature reached 950° C., it was maintained for 30 minutes to grow the ZnO nanowire.

Comparative Example 1

Preparation of ZnO Precursor Solution 0.005 M zinc acetate dehydrate and 0.005 M 2-ethanolamine were mixed in 2-methoxyethanol, and the mixture was stirred to prepare 0.005 M of a Zn acetate precursor solution.

Comparative Example 2

Fabrication of ZnO Thin Film

Using the Zn acetate precursor solution prepared in Example 2, a ZnO thin film was fabricated in the same manner as in Example 2.

Comparative Example 3

Fabrication of ZnO Nanowire

Using the Zn acetate thin film fabricated in Comparative Example 2 as a catalyst, a ZnO nanowire was grown in a thermal furnace. In order to grow the ZnO nanowire, the ZnO thin film fabricated in Comparative Example 2 was loaded into a thermal furnace and then heated up to 950° C. while supplying argon gas (Ar). When the process temperature reached 950° C., it was maintained for 30 minutes to grow the ZnO nanowire.

Measurement of ZnO Precursor Solution Decomposition Temperature

The decomposition temperature of the ZnO precursor solution prepared in Example 1 was measured and compared with the decomposition temperature of the Zn acetate precursor solution prepared in Comparative Example 1. Using a measuring equipment (TGA 2050, manufactured by TA Instruments), the weight difference was measured by elevating the temperature from room temperature to 600° C. at a speed of 5° C./min under an air atmosphere.

Figure 2:
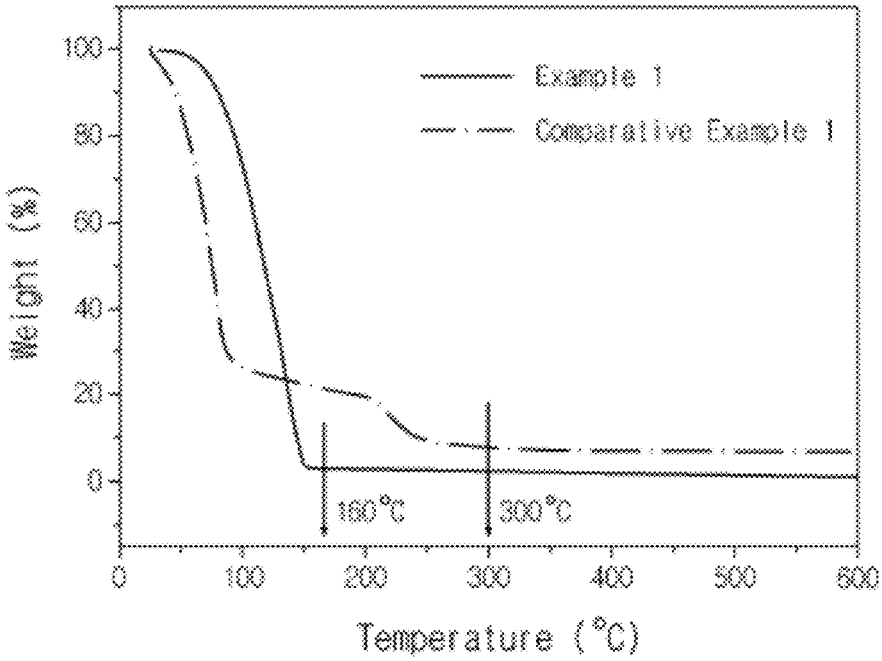
FIG. 2 is a graph illustrating the decomposition temperature of a ZnO precursor solution obtained in Example 1 and the decomposition temperature of a ZnO precursor solution obtained in Comparative Example 1.

As shown in the graph of FIG. 2, the decomposition temperature of the ZnO precursor solution (160° C.) prepared in Example 1 is lower than that of the Zn acetate precursor solution (300° C.) prepared in Comparative Example 1. Around this temperature, a low cost substrate such as a glass substrate or a plastic substrate can be used as the substrate of a ZnO thin film.

Measurement of ZnO Thin Film Homogeneity

Figure 3:
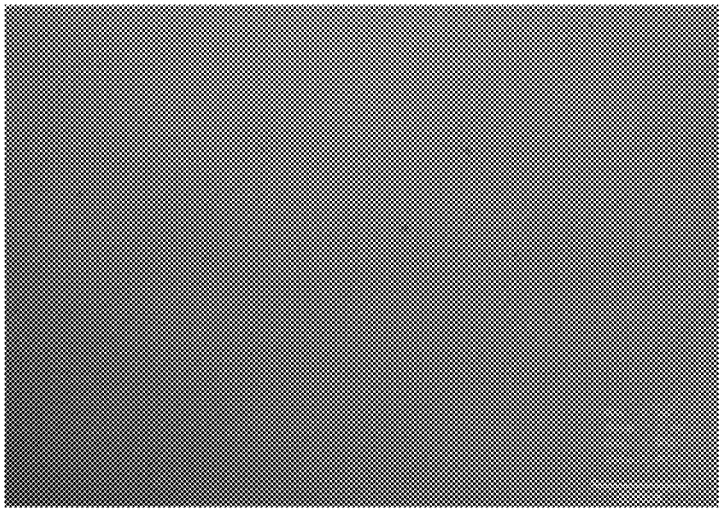
FIG. 3 is an optical image of a ZnO thin film obtained in Example 2.
Figure 4:
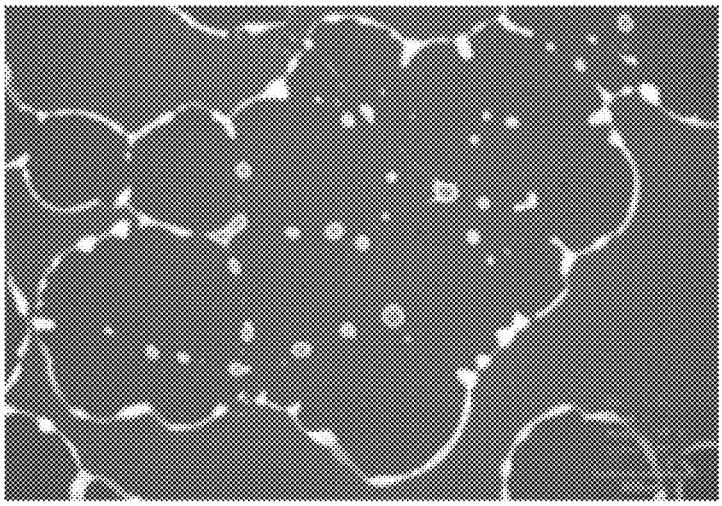
FIG. 4 is an optical image of a ZnO thin film obtained in Comparative Example 2.

Using an optical microscope, the homogeneity of the ZnO thin film obtained in Example 2 was compared with the ZnO thin film obtained in Comparative Example 2. In the case of the ZnO thin film obtained in Example 2, the overall substrate was coated homogeneously as shown in FIG. 3, while in the case of the ZnO thin film obtained in Comparative Example 2, homogeneous coating could not be obtained as shown in FIG. 4.

Measurement of ZnO Nanowire Homogeneity

Figure 5:
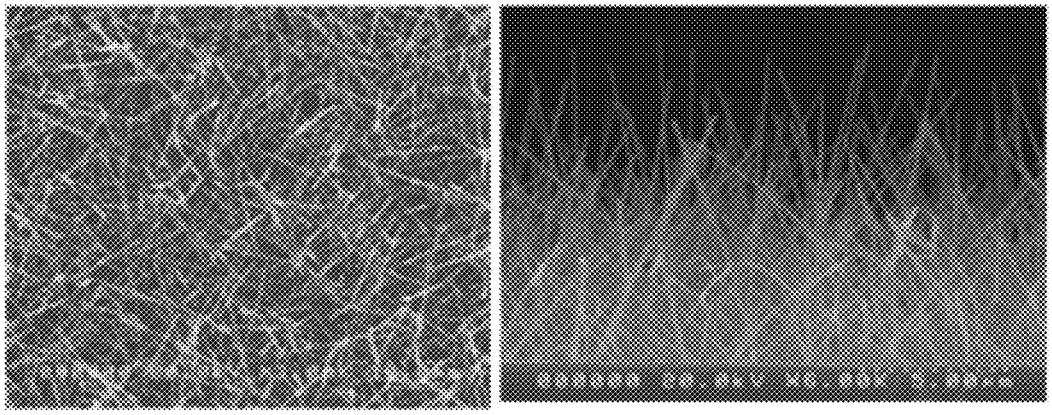
FIG. 5 is an SEM image of a ZnO nanowire obtained in Example 3.
Figure 6:
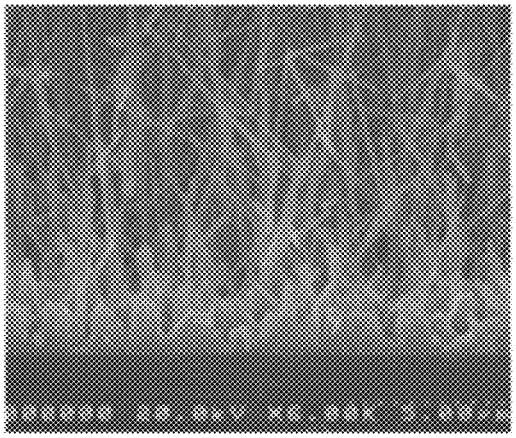
FIG. 6 is an SEM image of a ZnO nanowire obtained in Comparative Example 3.

SEM images of the ZnO nanowire obtained in Example 3 and the ZnO nanowire obtained in Comparative Example 3 were taken and shown in FIGS. 5 and 6 respectively, and their homogeneity was compared. As shown in FIG. 5, the ZnO nanowire obtained in Example 3 exhibited less interfacial impurities and excellent surface homogeneity. However, as shown in FIG. 6, the ZnO nanowire obtained in Comparative Example 3 had a plenty of interfacial impurities and had thick and irregular wire diameters.

While disclosed embodiments have been shown and described with reference to exemplary embodiments thereof, it will be understood by those of ordinary skill in the art that various changes in form and details may be made therein without departing from the spirit and scope of the present invention as defined by the following claims.

In addition, many modifications can be made to adapt a particular situation or material to the teachings of the invention without departing from the essential scope thereof. Therefore, it is intended that the invention not be limited to the particular embodiments disclosed as the best mode contemplated for carrying out this invention, but that the invention will include all embodiments falling within the scope of the appended claims. Moreover, the use of the terms first, second, etc. do not denote any order or importance, but rather the terms first, second, etc. are used to distinguished one element from another. Furthermore, the use of the terms a, an, etc. do not denote a limitation of quantity, but rather denote the presence of at least one of the referenced item.

What is claimed is:

1. A method for fabricating a ZnO thin film comprising:

preparing a precursor solution for ZnO thin film in a sol-form by using zinc hydroxide nitrate ($Zn_5(OH)_8(NO_3)_2.2H_2O$); and coating the precursor solution for ZnO thin films on a substrate;

drying the coated precursor solution to form a ZnO thin film; and curing the ZnO thin film, wherein the step of preparing the precursor solution for ZnO thin film in a sol-form comprises:

mixing an aqueous $Zn(NO_3)_2.6H_2O$ solution and NaOH to synthesize $Zn_5(OH)_8(NO_3)_2.2H_2O$; and mixing the $Zn_5(OH)_8(NO_3)_2.2H_2O$ and a stabilizer or modifier in a polar solvent while stirring.

2. The method according to claim 1, wherein the stabilizer comprises at least one selected from the group consisting of monoethanolamine, diethanolamine or triethanolamine.

3. The method according to claim 1, wherein the stabilizer comprises monoethanolamine.

4. The method according to claim 1, wherein the modifier comprises at least one selected from the group consisting of acetoin, dimethylamineborane, glycine or acetol.

5. The method according to claim 1, wherein the solvent is at least one selected from the group consisting of 2-methoxyethanol, ethanol, isopropanol, acetonitrile, or distilled water ($H_2O$).

6. The method according to claim 1, wherein the ZnO precursor solution comprises at least one element selected from the group consisting of aluminum (Al), indium (In), gallium (Ga), boron (B), iron (Fe), stibium (Sb), lithium (Li), phosphor (P), or arsenic (As).

7. The method according to claim 1, wherein the curing is carried out at a temperature less than 200° C.

8. The method according to claim 1, wherein the curing is carried out at a temperature of 200° C. or higher.

9. The method according to claim 1, wherein zinc in the precursor solution for a ZnO thin film has a concentration of 0.0005 to 1 M.

10. The method according to claim 1, wherein the solvent in the precursor solution for a ZnO thin film is evaporated so that the concentration of zinc is controlled to be 0.1 M or higher without forming any precipitate.

11. The method according to claim 1, wherein the stabilizer or modifier has a concentration of 5 to 100-fold of the concentration of zinc in the precursor solution for a ZnO thin film.

12. The method according to claim 1, wherein the ZnO thin film is coated using a spin coating, a dip coating, a roll coating, a screen coating, a spray coating, a spin casting, a flow coating, a screen printing, an ink jet, or a drop casting.

13. The method according to claim 1, wherein the substrate is at least one selected from the group consisting of a wafer substrate, an ITO substrate, a quartz glass substrate, or a plastic substrate.

* * * * *